United States Patent [19]

Tobias

[11] Patent Number: 4,919,240

[45] Date of Patent: Apr. 24, 1990

[54] EXPANDABLE VALISE

[76] Inventor: Charles S. Tobias, Box 626, Road Town, Tortola, V.I.

[21] Appl. No.: 356,722

[22] Filed: May 25, 1989

[51] Int. Cl.[5] ..... A45C 7/00; A45C 13/26; A45C 13/30

[52] U.S. Cl. ..... 190/103; 190/107; 190/116; 190/27; 150/108; 383/2

[58] Field of Search ..... 190/103–105, 190/107, 119, 902, 116, 124, 26, 27, 100; 150/108; 383/2; D3/77

[56] References Cited

U.S. PATENT DOCUMENTS

| | | | |
|---|---|---|---|
| 179,745 | 7/1876 | Blake | 190/103 |
| 189,410 | 4/1877 | Worthington | 190/104 |
| 258,660 | 5/1882 | Marsh | 190/116 X |
| D. 260,324 | 8/1981 | Koves | D3/42 |
| D. 264,399 | 5/1982 | Koves | D3/42 |
| D. 264,523 | 5/1982 | Stark | D3/48 |
| D. 265,779 | 8/1982 | Stark | D3/71 |
| D. 267,677 | 1/1983 | Pelavin | D3/71 |
| D. 268,305 | 3/1983 | Stark | D3/71 |
| D. 269,738 | 7/1983 | Stark | D3/77 |
| 277,497 | 5/1883 | Marshall | 190/107 X |
| 296,993 | 4/1884 | Moffly | 190/107 X |
| 495,151 | 4/1893 | Desmarais | 190/104 |
| 518,478 | 4/1894 | Allen | 190/115 |
| 693,737 | 2/1902 | Phillips | 190/104 |
| 841,902 | 1/1907 | Shumard | 190/107 X |
| 852,729 | 5/1907 | Limbacher | 190/107 |
| 909,325 | 1/1909 | Patch | 190/115 X |
| 1,090,553 | 3/1914 | Mashek | 190/109 |
| 1,239,130 | 9/1917 | Schuman | 190/116 |
| 1,636,838 | 7/1927 | Roser | 190/103 |
| 1,638,753 | 8/1927 | Stein et al. | 190/902 X |
| 1,658,997 | 2/1928 | Mulford | 190/109 |
| 1,731,547 | 10/1929 | Stansbury | 190/902 X |
| 1,754,663 | 4/1930 | Adams | D3/77 X |
| 1,834,740 | 12/1931 | Rhett | 190/107 |
| 1,940,900 | 12/1933 | Barnard | 190/103 X |
| 2,105,319 | 1/1938 | Hedden et al. | 190/1 |
| 3,173,465 | 3/1965 | Pastini | 383/2 X |
| 3,587,795 | 6/1971 | Berry et al. | 190/103 X |
| 4,117,914 | 4/1978 | Snyder | 190/110 |
| 4,148,347 | 4/1979 | Seaman | 383/2 |
| 4,261,448 | 4/1981 | Myers et al. | D3/77 X |

*Primary Examiner*—Sue A. Weaver
*Attorney, Agent, or Firm*—David H. Semmes

[57] ABSTRACT

An expandable and collapsible valise is described as rigidized and supported against distortion by at least two vertical encircling adjustable straps and one horizontal encircling adjustable strap, the vertical straps being retained in situ by means of a topmost movable batten having strap retention keepers thereon. Additional vertical strap retention keepers are at the bottom of the valise. The vertical straps overlay a horizontally disposed retention strap, adjustably supported adjacent the bottom of the valise being likewise secured against displacement. The bottom of the valise is characterized by convolute portions which, being an extension of the front and rear panels of the valise are extensible and contractible, depending upon the content volume of the valise.

4 Claims, 3 Drawing Sheets

EXPANDABLE VALISE

RELATED APPLICATIONS

U.S. design patent application Ser. No. 202,156, filed June 23, 1988, by inventor Charles S. Tobias.

BACKGROUND OF THE INVENTION

The invention relates to portable and collapsible valises wherein an expandable configuration may be adjustably conformed to varying content volume and stabilized against distortion as in traveling. Stability is achieved by a combination of a batten, vertical and horizontally disposed reinforcing straps, the latter of which extend from points in the rear, around the sides and fully across the front of the bag. In the preferred configuration, an adjustable horizontal reinforcing strap extends rear to front and around the sides of the valise. In addition, vertical reinforcing straps which are set and disposed in parallel relation relative to the valise container, extend not only fully around the upright exterior thereof but also secure the top by extending through a substantially rigid batten. Whereas numerous valise and pouch containers have been devised with reinforcing straps engaging the exterior thereof, no such combination horizontal and vertical adjusting straps with rigid top batten has been devised to stabilizle an expandable valise, irrespective of the content volume.

SUMMARY OF THE INVENTION

The invention is an expandable and collapsible valise, rigidized and supported against distortion by at least two vertical straps and one horizontally extending adjustable strap, the vertical straps being retained in situ by means of a top batten, having vertical retention keepers there, and corresponding vertical straps are affixed to the bottom of the valise. The vertically disposed straps overlap a horizonally extending adjustable strap extending around the lower portion of the valise and secured by side keepers affixed to the lower sides of the valise.

Figure 1:
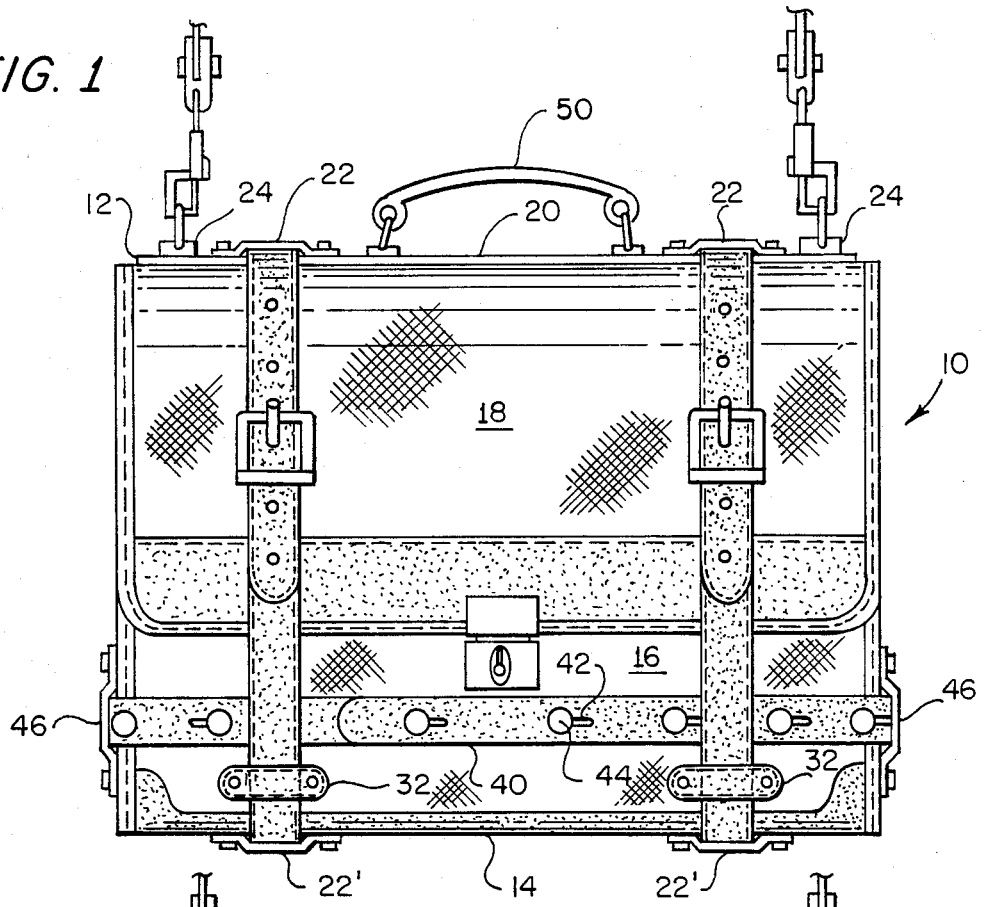
FIG. 1 is a front elevation view of the valise.
Figure 3:
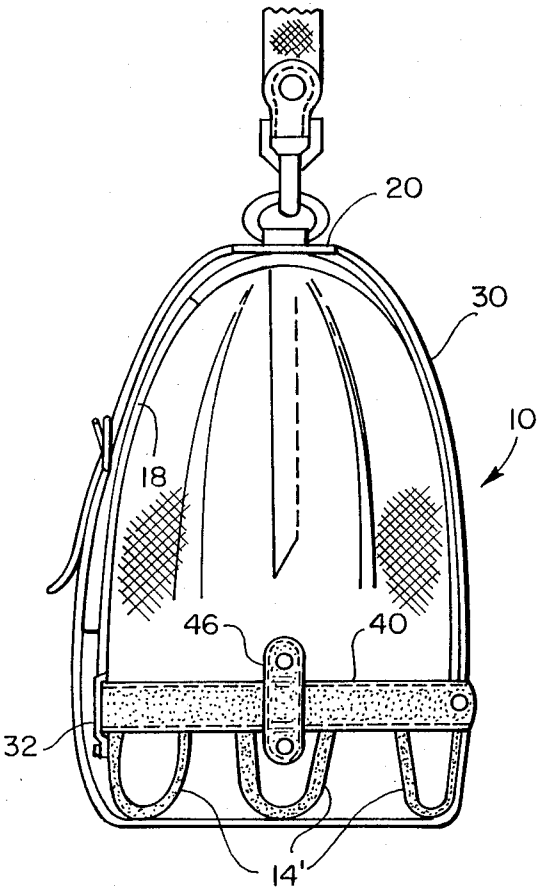
FIG. 3 is an end elevation.
Figure 6:
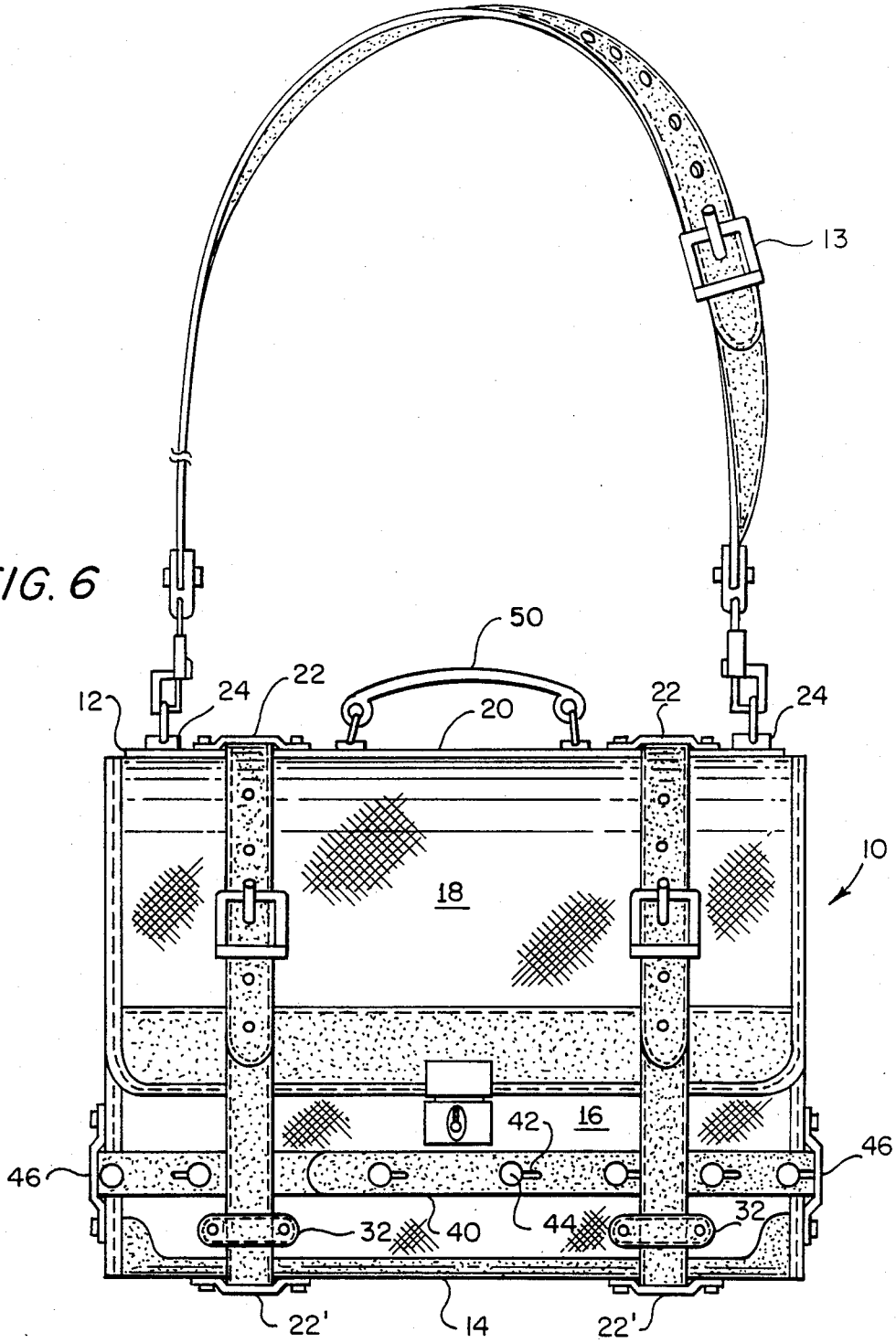

DESCRIPTION OF THE PREFERRED EMBODIMENTS:

The expandable valise 10 is illustrated in FIG. 1 as having top 12, bottom 14, front panel 16, rear panel 16', with interconnected side panels 17. Top 12 terminates in an overlapping flap 18 and, at the bottom, the base includes extensible-collapsible folds 14'. An appropriate handle 50 is secured to top rigid batten 20. Batten 20 has opposed strap keepers 22 attached thereto, adjacent nits ends. Similar strap keepers 22' are affixed at the bottom of the valise. As illustrated in FIG. 3, inermediate the ends of batten 20 are the shoulder strap anchors 24. Batten 20 mayb e centered adjustably upon top 12, as the content volume of the valise dictates.

Plural vertical straps 30 are disposed for retention in parallel alignment, so as to pass through the respective top keepers 22 and bottom keepers 22'. Vertical straps 30 likewise pass through appropriate guides or keepers 32 on the front of the valise and 32' on the rear thereof.

An adjustable horizontal strap 40 is adapted to fully encircle the valise adjacent its bottom and beneath the vertically extending parallel straps 30. This horizontal valise retention strap 40 has its free ends positioned contiguous the front panel of the valise in overlapping disposition whereby adjustable apertures 42 thereof may engage adjustment rivets or studs 44 as shown in FIG. 1.

Figure 2:
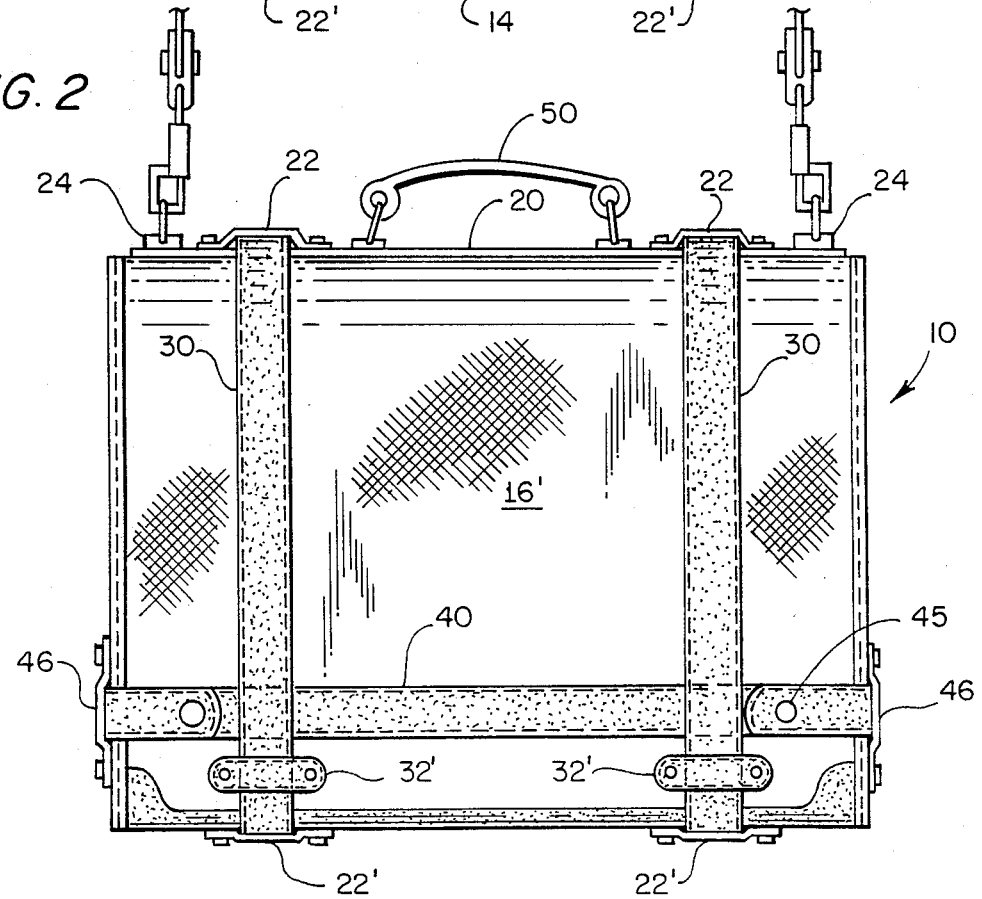
FIG. 2 is a rear elevation.
Figure 4:
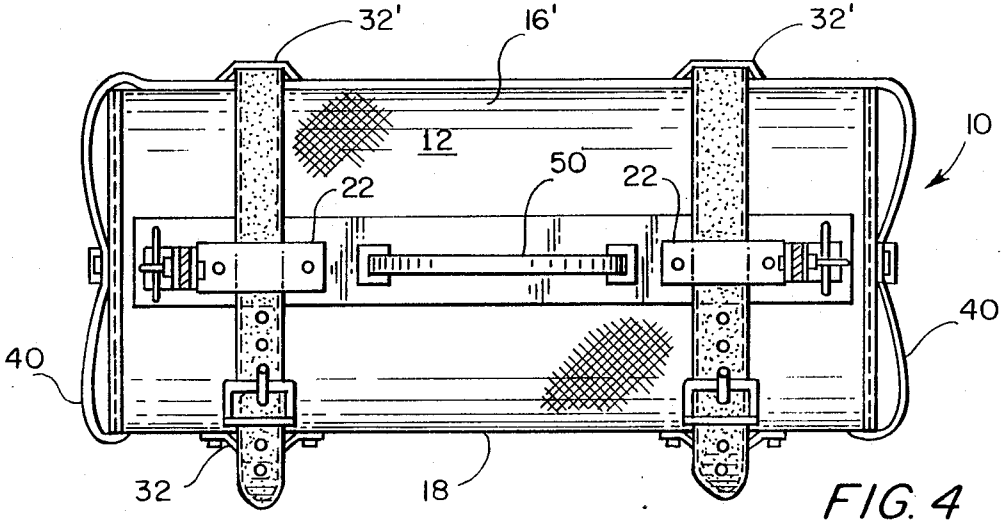
FIG. 4 is a top plan.

Referring to FIG. 2, the rear view of device 10, we find that horizontal strap 40 may be appropriately further secured to the lower sides by compressing rivets 45 or the like. Together with the front portion, the rear strap portion fully encircles the valise, the samem being retained by side keepers 46.

Figure 5:
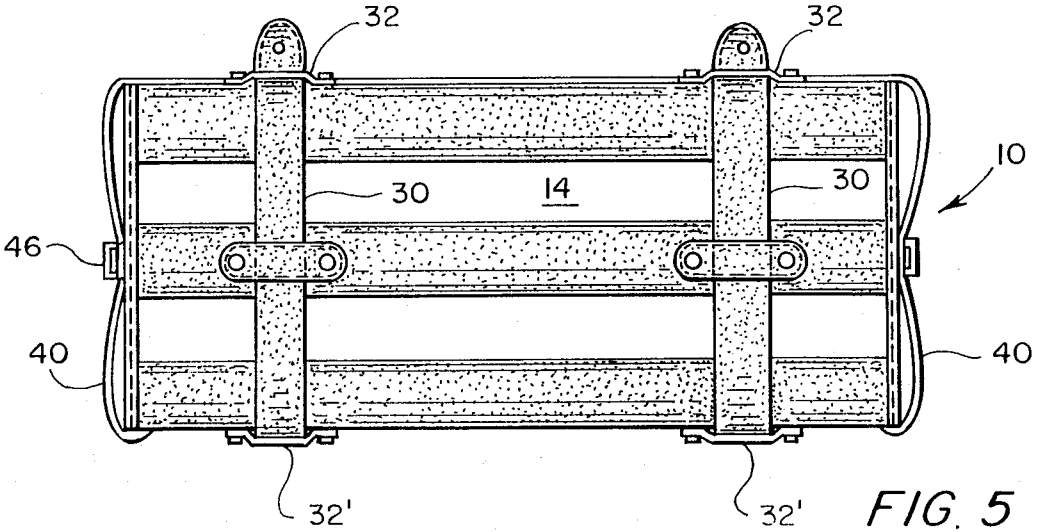
FIG. 5 is a bottom plan.

Referring to FIG. 3, it will be noted that the lower portion or bottom 14 of valise 10 includes vertical folds 14' the same being compressible relative to each other and extensible, depending upon content volume of the device. Folds 14' are likewise shown in FIG. 5 and, in the position there shown, form a substantial distortion-free base for the valise.

I claim:

1. A collapsible-expandable valise, comprising:

(a) enclosable top, front, rear, and side panels, and an extensible-contractible bottom panel, including flexible convolutions extending between said side panels;

(b) a rigid batten, centered adjustably upon said top panel, said rigid batten supporting top vertical strap keepers adjacent opposed ends of the batten, and two shoulder strap anchors at the ends of said batten;

(c) plural vertical straps, vertically encircling the valise, said vertical straps being adjustably secured to said batten bys aid top keepers affixed to said batten, and adjustably secured to said bottom panel by bottom keepers affixed to said bottom panel, and nadjustablys ecurd to said front and rear panels by front and rear strap guides affied respectively tos aid front and said rear panels;

(d) a horizontal encircling valise strap positioennd adjacent said bottom panela nd adjustablys ecured tos aid side panels by side keepers, said horizontals trap containing adjusting apertures wherebys aid horizontal strap is adjustable in length, relative to the overall exterior circumference of the said side panels and said front and rear panels, as defined bys aid flexible convolutions; and (e) adjusting studs protruding from at least one of said panels, so as to complementally engage and secure said encircling valise strap adjusting apertures.

2. A collapsible-expandable valise as ain claim 1, said adjusting n struds extending laterally from said front panel in the path of said horizontal strap.

3. A collapsible-expandable valise as in claim 1, including a carrying handle medially positioned upon said rigid batten.

4. A collapsible-expandable valise asa in claim 1 with a shoulder strap removably fixed at either end of said batten by said shoulder strap anchors so as ato extend above said valise during carrying.

* * * * *